US007682446B2

(12) United States Patent
Goldate et al.

(10) Patent No.: US 7,682,446 B2
(45) Date of Patent: Mar. 23, 2010

(54) METHOD TO IMPROVE THE CHARACTERISTICS OF ASH FROM MUNICIPAL SOLID WASTE COMBUSTORS

(75) Inventors: William C. Goldate, Toms River, NJ (US); Giuseppe Aldina, Chatham, NJ (US)

(73) Assignee: Convanta Holding Corp., Fairfield, NJ (US)

( * ) Notice: Subject to any disclaimer, the term of this patent is extended or adjusted under 35 U.S.C. 154(b) by 695 days.

(21) Appl. No.: 11/529,292

(22) Filed: Sep. 29, 2006

(65) Prior Publication Data

US 2008/0078306 A1 Apr. 3, 2008

(51) Int. Cl.
*C04B 18/06* (2006.01)

(52) U.S. Cl. ..... 106/705; 73/53.01; 73/866

(58) Field of Classification Search ..... 106/DIG. 1, 106/705; 73/53.01, 866
See application file for complete search history.

(56) References Cited

U.S. PATENT DOCUMENTS 5,245,122 A * 9/1993 Smith ..... 588/257
2005/0137444 A1* 6/2005 Chang ..... 588/313

* cited by examiner

*Primary Examiner*—Paul Marcantoni
(74) *Attorney, Agent, or Firm*—Hogan & Hartson LLP

(57) ABSTRACT

In a combustion facility, a portion of the bottom ash (BA) is mixed with substantially all of the fly ash (FA) as necessary to obtain a stabilized material that prevents toxic metals solubility and achieves a desired TCLP extraction pH value, preferably in the range of 8-11. The actual quantities of BA to be mixed with FA will vary depending upon various factors, so embodiments of the present invention include testing the ash to determine the desired distribution to achieve sufficient alkalinity to prevent the leaching of toxic metals in landfills. Because the resulting ash has a desired alkalinity by design, minimal additional alkali reagent amendment is necessary for safe disposal of the waste ash. The remaining BA may be recycled or deposited in a landfill without additional processing. Valuable materials in the waste ash may also be more easily recovered and reused.

18 Claims, 5 Drawing Sheets

METHOD TO IMPROVE THE CHARACTERISTICS OF ASH FROM MUNICIPAL SOLID WASTE COMBUSTORS

FIELD OF THE INVENTION

The present invention relates generally to an improved methodology for treating waste ash produced through the incineration of solid waste at municipal solid waste combustors. More specifically, the present invention relates to a methodology for processing the waste ash in an environmentally safe and economical manner while reducing the need for additives or other processing. The ash is managed to achieve two uniform ash streams that do not exhibit the characteristics of a hazardous material and to improve the recycling suitability of the bottom ash.

BACKGROUND OF THE INVENTION

Municipal solid waste (MSW) handling and disposal has received substantial attention by regulatory agencies, as well as by interested environmental groups. For the purpose of this application, MSW is defined as the gross product which is collected and processed by municipalities and governments. MSW includes durable and non-durable goods, containers and packaging, food and yard wastes, and miscellaneous inorganic wastes from residential, commercial and industrial sources. Examples include newsprint, appliances, clothing, scrap food, containers and packaging, disposable diapers, plastics of all sorts including disposable tableware and foamed packaging materials, rubber and wood products, potting soil, yard trimmings and consumer electronics, as part of an open-ended list of disposable or throw-away products.

Disposing of waste in a landfill is the most traditional method of waste disposal, and it remains a common practice in most countries. Many local authorities, especially in urban areas have found it difficult to establish new landfills due to opposition from owners of adjacent land, since few people want a landfill in their local neighborhood. As a result, solid waste disposal in these areas has become more expensive as material must be transported for disposal.

The substantial amount of MSW may be reduced by combustion at municipal solid waste combustors (MWC), also known as waste-to-energy (WTE) plants. Due to the need to decrease the amount of material placed into landfills, along with improved operating equipment and procedures that minimize resulting pollutants, WTE plants are finding increased acceptance and popularity.

One by-product of WTE plant operation is ash. The ash generally represents about one-fourth of the mass of MSW prior to processing. Various techniques are known for the disposal of MWC ash. For example, electric plasma torches may be used to melt incinerator ash into inert glassy pebbles that are valuable in concrete production. MWC ash may also be chemically separated into lye and other useful chemicals. Alternatively, the ash may be incorporated in portland cement furnaces. However, these techniques all have severe disadvantages, such as requiring complex and costly machinery or chemical treatment.

The most common technique for disposing of MWC ash is to deposit it into landfills. However, the ash must be tested and treated as needed for safe landfill disposal to prevent contamination of underground aquifers. The potential dangers of hazardous contaminants found in the ash, and in particular, heavy metals such as lead, arsenic, chromium, copper and cadmium, have been well documented and are the subject of numerous regulatory controls to reduce or eliminate the dangers to people and to the surrounding environment.

Solid waste disposal is regulated by both federal and state agencies through laws and regulations. In particular, the Resource Conservation and Recovery Act (RCRA) and the regulatory agencies operating under the Act, as embodied in Title 40 of the Code of Federal Regulations and its state regulatory equivalents, have established maximum safe limits for certain contaminants in solid waste. In 1995, in response to the United States Supreme Court decision in *City of Chicago v. Environmental Defense Fund* (114 S. Ct. 1588 (1994) regarding the RCRA requirement to test ash from MWCs, the Environmental Protection Agency issued guidelines for testing ash samples utilizing the toxicity characteristic leachate procedure (TCLP), also referred to as EPA Testing Method 1311 and described in EPA publication SW846, to determine whether the ash exhibits the characteristic of a hazardous waste. Before leaving the WTE plant, the MWC waste ash must pass test criteria for either final disposal in a landfill or reuse.

For example, 40 C.F.R. §261.24, contains a list of contaminants and their associated threshold concentrations in an extract of solid waste, as set forth below in Table 1:

TABLE 1

Maximum Concentration of Contaminants for the Toxicity Characteristic

| Contaminant | Regulatory Level (mg/L) |
|---|---|
| Arsenic | 5.0 |
| Barium | 100.0 |
| Benzene | 0.5 |
| Cadmium | 1.0 |
| Carbon tetrachloride | 0.5 |
| Chlordane. | 0.03 |
| Chlorobenzene | 100.0 |
| Chloroform. | 6.0 |
| Chromium. | 5.0 |
| o-Cresol | 200.0 |
| m-Cresol | 200.0 |
| p-Cresol | 200.0 |
| Cresol | 200.0 |
| 2,4-D | 10.0 |
| 1,4-Dichlorobenzene | 7.5 |
| 1,2-Dichloroethane | 0.5 |
| 1,1-Dichloroethylene | 0.7 |
| 2,4-Dinitrotoluene | 0.13 |
| Endrin | 0.02 |
| Heptachlor (and its epoxide). | 0.008 |
| Hexachlorobenzene | 0.13 |
| Hexachlorobutadiene | 0.5 |
| Hexachloroethane | 3.0 |
| Lead | 5.0 |
| Lindane | 0.4 |
| Mercury | 0.2 |
| Methoxychlor | 10.0 |
| Methyl ethyl ketone | 200.0 |
| Nitrobenzene | 2.0 |
| Pentrachlorophenol | 100.0 |
| Pyridine | 5.0 |
| Selenium | 1.0 |
| Silver | 5.0 |
| Tetrachloroethylene | 0.7 |
| Toxaphene | 0.5 |
| Trichloroethylene | 0.5 |
| 2,4,5-Trichlorophenol | 400.0 |
| 2,4,6-Trichlorophenol | 2.0 |
| 2,4,5-TP (Silvex) | 1.0 |
| Vinyl chloride | 0.2 |

If a contaminant equals or exceeds its threshold concentration when tested using the TCLP analysis as specified at 40

C.F.R. §260.11 (described in greater detail below), then the material is classified as being toxic and cannot be deposited into a non-hazardous waste landfill or ash monofill without first being treated. In addition, there exist various states such as California, Michigan and Vermont which require additional leaching tests on solid waste in order to classify the waste, and these states direct the heavy metal leaching wastes to hazardous waste landfills.

The TCLP test is designed to simulate the leaching of heavy metals that could potentially occur over time in a solid waste landfill when precipitation passes through the deposited ash. The TCLP procedures distinguish between ash with low alkalinity and ash with high alkalinity, and determination of the alkalinity of the material is the first step in the TCLP procedure so the appropriate extraction test fluid can be used. These test procedures add a known amount of acid to a small aliquot of the ash suspended in solution and measure the pH of the solution. For low alkalinity ash (test solution pH <5) a mild acetic acid/sodium hydroxide/water extraction fluid is used (fluid 1 having pH value of 4.93) for the TCLP test. For high alkalinity ash (defined to be a test solution having pH greater than 5) an acetic acid/water extraction fluid (fluid 2 having a pH of 2.88) is used. In an exemplary TCLP test, a single extraction of waste ash is tumbled in an appropriate acetic acid extract for 16 to 20 hours. The extract is filtered, digested and analyzed to establish the leachability of the elements of concern. If the determined value is equal to or greater than the limit for that element, the waste is categorized as hazardous and must be specially processed for disposal.

Various known methods may be used to treat hazardous ash, such as the addition of various chemicals to remove or otherwise nullify the hazardous contaminants. However, these treatment processes are relatively expensive and complex. Moreover, it is generally desirable to reduce the dependence on potentially hazardous additives. Accordingly, there is a current need for a method to handle the MWC waste ash with reduced chemical additives and other processing.

Referring now to FIG. 1 (PRIOR ART), a MWC 100 receives and combusts the MSW 110. The combustion produces ash content that is classified as either bottom ash (BA) 120 or fly ash (FA) 130. At the present time in the United States, typically all of the ash streams are combined, and this combined stream is referred to as combined ash.

The term bottom ash is commonly used to refer to the grate ash, siftings 121 and, in some cases, the boiler ash stream. Approximately 90 percent of the bottom ash stream consists of grate ash, which is the ash fraction that remains on the stoker or grate at the completion of the combustion cycle. It is similar in appearance to porous, grayish, silty sand with gravel, and contains small amounts of unburned organic material and chunks of metal. The grate ash stream consists primarily of glass, ceramics, ferrous and nonferrous metals, and minerals. As explained in greater detail below, the bottom ash 120 comprises approximately 75 to 80 percent of the total combined ash stream in known combined ash systems.

The Fly ash 130 refers to the ash collected in the air pollution control system, which includes the scrubber ash and precipitator or baghouse ash. Boiler ash, scrubber ash, and precipitator or baghouse ash consist of particulates that originate in the primary combustion zone area and are subsequently entrained in the combustion gas stream and carried into the boiler and air pollution control system. As the combustion gas passes through the boiler, scrubber, and precipitator or baghouse, the entrained particulates stick to the boiler tubes and walls (i.e., boiler fly ash 131) or are collected in the air pollution control equipment (i.e., Flue gas fly ash 132), which consists of the scrubber, electrostatic precipitator, or baghouse. Ash extracted from the combustion gas consists of very fine particles, with a significant fraction measuring less than 0.1 mm in diameter. The baghouse or precipitator ash comprises approximately 10 to 15 percent of the total combined ash stream.

Thus, the FA 130 comprises lighter particles which are carried off the burning grate by convection or turbulence, boiler fly ash 131, or form in the flue gas cleaning system, flue ash 132. Fly ash 130 is removed by electrostatic precipitators or collection bags in a fabric filter. Fly ash can also include the superheater or economizer ash which collects on internal parts of the boiler system which are blown down or removed from time to time and combined with the fly ash fraction.

The flue ash 132 frequently contains spent lime from an air pollution control system (APC) in which a lime reagent is sprayed into the flue gases to neutralize sulfur dioxide and hydrochloric and other acids. The hot flue gases evaporate the water portion, leaving a dry powder residue 132 which is removed in a fabric filter and may be combined with the boiler fly ash 131.

Referring now to FIG. 2 (PRIOR ART), a conventional ash processing method 200 is presented. In summary, during the conventional method of ash mixing and disposal 200, all of the FA and the BA from a plant are combined, and the resulting combined ash (CA) is subjected to possible treatment and periodic TCLP testing before it is disposed in a non-hazardous landfill. Specifically, after the incineration of the solid waste in step 210 and the collection of the bottom ash 120 from different pieces of equipment (e.g., grate and boiler)and the fly ash 130 from flue gas treatment equipment (e.g., scrubbers and fabric filters), respectively steps 220 and 230, it is common practice at MWC facilities to mix all the bottom ash 120 and fly ash 130 to form CA, step 240.

The CA exiting the MWC facility must meet the TCLP requirements of a non-hazardous material to be acceptable for disposal in a non-hazardous solid waste landfill or ash monofill. Thus, the CA is tested in step 250, typically using the TCLP guidelines as described above, and if found to be hazardous, the CA must be treated in step 260 using various known techniques prior to disposal of the treated CA in step 270. In general, one goal of processing the ash is to achieve a stabilized material with sufficient alkalinity (e.g., pH range of approximately 8-11 for the TCLP extracted material as described in greater detail below) to prevent any acidic attack from allowing the solubility of toxic metals in the leachate solutions.

It should be appreciated that the BA or FA may also be treated prior to combining the ashes in step 240. For example, the FA from an MWC air pollution control system (APC) is frequently treated using a calcium oxide/hydroxide lime slurry spray dryer absorber with a fabric filter. This treated FA will then contain excess alkalinity due to un-reacted calcium oxide/hydroxide, whereas the BA is typically a low alkalinity material. Due to the high alkalinity of the FA from the flue gas treatment with its relatively high calcium content, CA appears to be mostly alkaline, but often at the low end of the desired pH range and at times even lower. When all the BA is mixed with the FA, as is the usual practice in step 240, the resulting material has a diluted total alkalinity, which can result in unacceptably low pH values in testing step 250 that permit the solubility of toxic metals in the extract. Consequently, the standard practice of mixing all the BA with the FA in step 240 is counterproductive to the goal of achieving a stabilized end material with sufficient alkalinity to prevent any acidic attack from allowing the solubility of toxic metals in the leachate solutions.

To address the low alkalinity in the CA and to otherwise improve the alkaline characteristics of the CA, it is often necessary to add an alkaline reagent, such as additional lime or dolomitic lime, to the CA stream during treatment step 260. Also, the alkaline reagent is often added to CA in step 260 as precaution due to the non-homogeneous nature of MSW, which causes the CA during testing step 250 to occasionally exhibit alkaline characteristics using fluid determination testing and acidic characteristics using extraction testing.

This alkaline reagent treatment results in considerable capital and operating expenses, including the costs associated with special equipment, the amendment reagent and increased quantities requiring disposal (due to the increase in overall volume and weight of the ash). Accordingly, it is a goal of the present invention to provide an ash processing methodology that is less reliant on the addition of an alkaline reagent.

Moreover, the overall combined ash testing and treatment process is wasteful in that potentially useful materials from the incineration are not reused. Specifically, another problem with the known ash processing method 200 is that after the BA from the combustor grate and boiler is mixed with the FA from the flue gas treatment system, the BA becomes coated with reacted and un-reacted lime and, perhaps, activated carbon. These spent reagents and reaction products are sticky and adhere to the BA, making it difficult to recycle materials in the BA. It is often not practical to wash the spent reagents and reaction products off the BA since a large stream of waste water and slurry would be created that contains the FA and reagents. This waste stream would be very difficult to dispose of in a landfill. Therefore, there is a need for an ash management method that would not only reduce or eliminate the need for the addition of amendment reagents, but would also leave a large portion of the BA free from contamination for potential recycling (i.e., in asphalt or concrete).

BRIEF SUMMARY OF THE INVENTION

In response to these and other needs, the present invention provides a better and less expensive method to achieve a stabilized, non-hazardous material (typically, strongly bound calcium carbonate and metals complexes) from MWC ash that is reduced in overall mass and has increased recycling potential.

In the present invention, a smaller percentage of the BA is mixed with the FA as necessary to obtain stabilized materials that prevent toxic metals solubility and achieve a desired TCLP pH value, preferably in the range of 8-11. Specifically, embodiments of the present invention determine a correct mixture of the FA/BA to achieve a CA product with sufficient alkalinity to prevent acidic attack from breaking the carbonate complexes that prevent toxic metal solubility in landfill leachates. Because the resulting CA has a desired alkalinity by design, the need for addition of the alkali reagent amendment (e.g., dolomitic lime) for safe disposal of the CA is minimized or eliminated. Additionally, the remaining BA may be used for potential recycling or separately deposited in a landfill.

The actual quantities of BA to be mixed with FA will vary from plant to plant, depending upon various factors, including the type of the combustor used at the MWC, characteristics of the MSW combusted, type of flue gas treatments, type of lime used and stoichiometry of the acid gas control system operation, etc. Accordingly, embodiments of the present invention entail testing the BA and FA to determine the desired distribution of BA and FA in the CA stream. Specifically, combinations of the FA and BA are tested to determine a mixture amount for a CA that will produce a desired alkalinity level to reduce or otherwise eliminate the need for additional alkaline additives.

BRIEF DESCRIPTION OF THE DRAWINGS

A more complete understanding of the present invention and advantages thereof may be acquired by referring to the following description taken in conjunction with the accompanying drawings, in which like reference numbers indicate like features, and wherein.

DETAILED DESCRIPTION OF THE INVENTION

Figure 1:
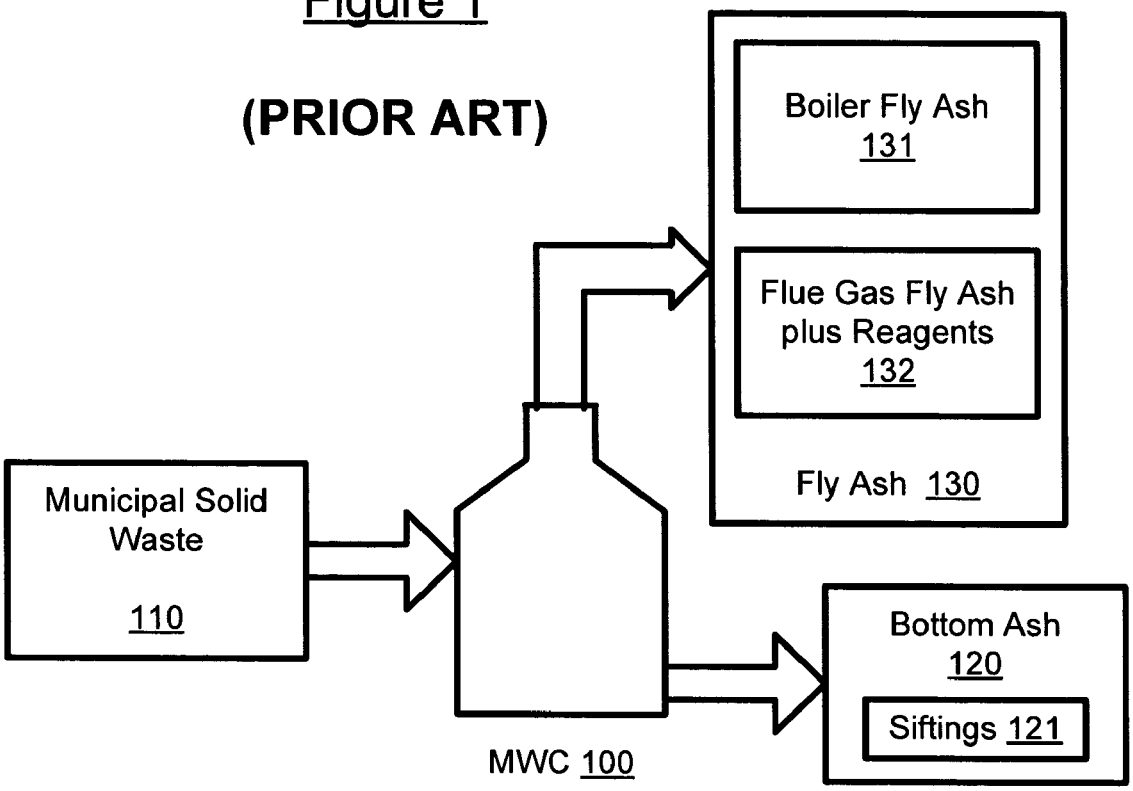
Figure 1 (PRIOR ART)
FIG. 1 (Prior Art) is a schematic depiction of a known Municipal Waste Combustion (MWC) plant.
Figure 2:
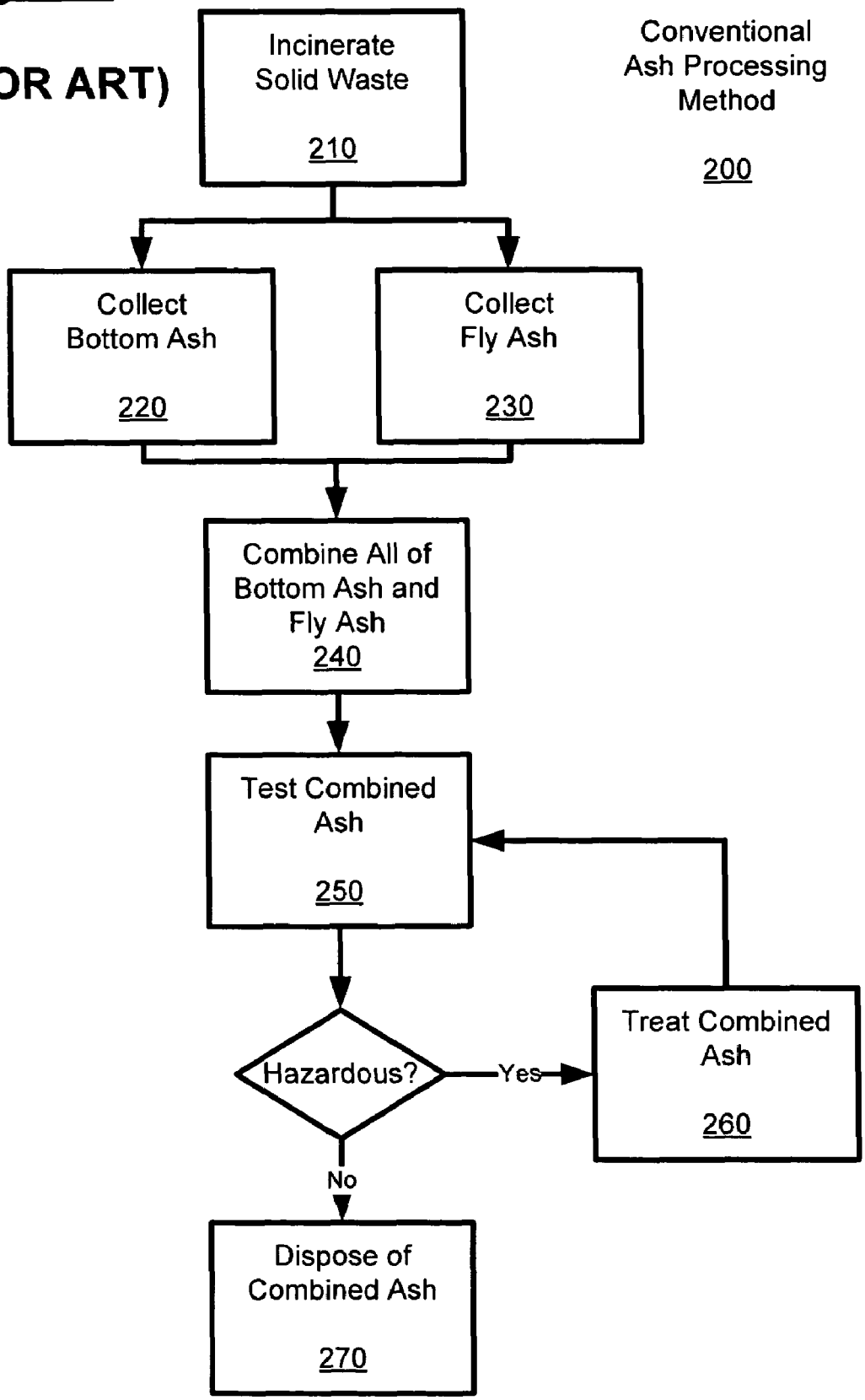
Figure 2 (PRIOR ART)
FIG. 2 (Prior Art) is a flow chart diagram depicting the steps in a known method for the processing of waste ash from the MWC of FIG. 1.
Figure 3:
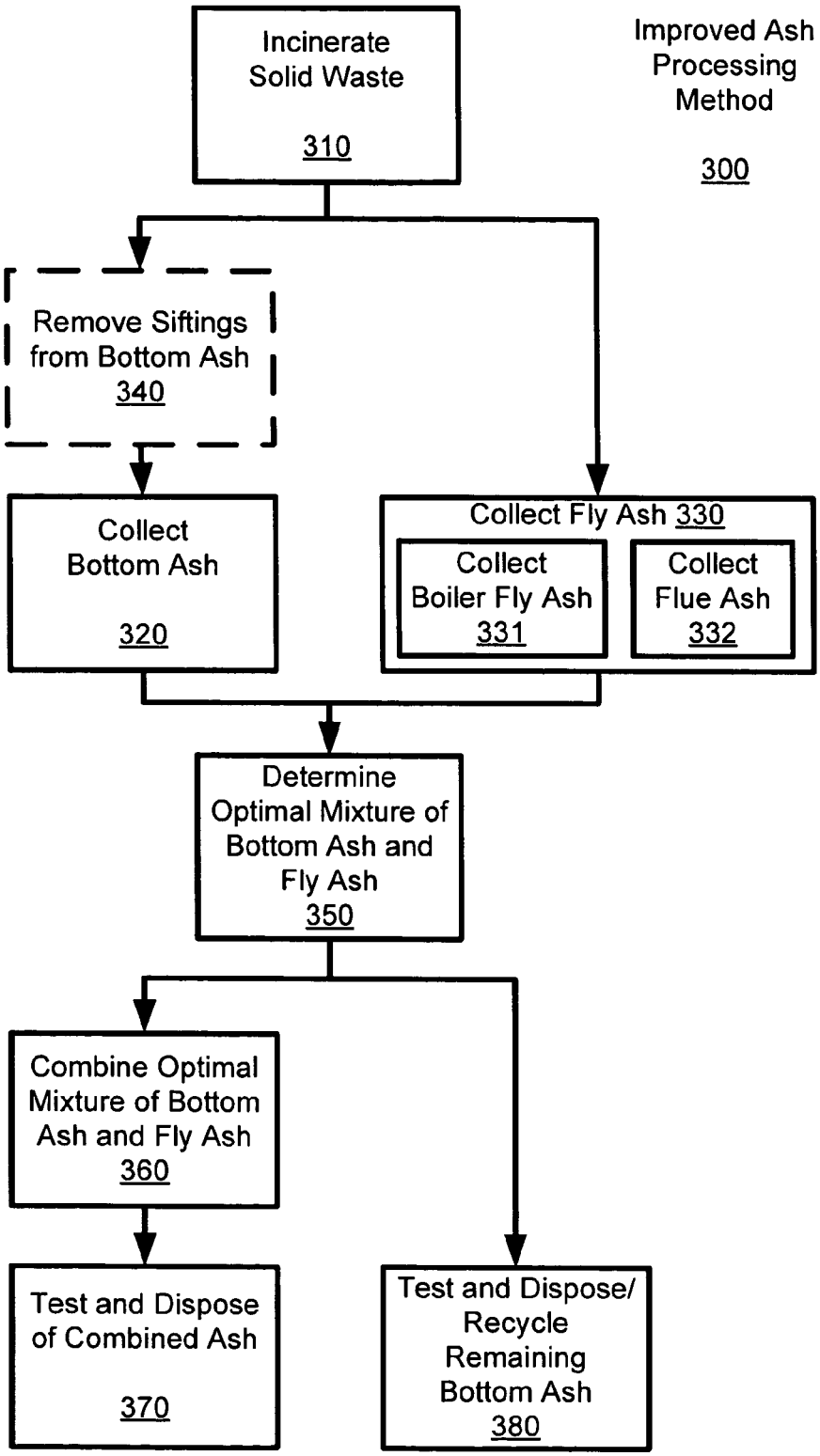
FIGS. 3-4 are flow chart diagrams depicting the steps in an improved method for the processing of waste ash from a MWC in accordance with embodiments of the present invention.

Referring now to FIG. 3, the present invention provides an improved ash processing method 300. As described in greater detail below, in ash processing method 300, the FA 132 from a flue gas treatment system is combined with a portion of the BA 120 (which may additionally include boiler FA 131 and/or siftings). The resulting CA mix is subjected to periodic TCLP testing, and typically meets regulatory requirements with minimal additional processing or additives.

In the ash processing method 300, following the incineration of the MSW in step 310, the BA and FA are collected, respectively in steps 320 and 330. Specifically, the collection of the FA in step 330 includes collection of the boiler FA in step 331 and the flue ash in step 332 using known techniques. Typically, the collection of the flue ash in step 332 includes treatment of the flue ash, as described above, through the addition of alkaline lime reagents.

In step 350, various combinations of the FA and BA are tested to determine an optimal amount of the BA to add to the FA. A rigorous procedure for determining the BA/FA ratio would require evaluation of the disassociation equilibrium of the mixture of conjugated acids and bases in the individual ash streams to determine the disassociation constant for the material. The individual ash streams from an MWC each contain a complex mixture of components that make it impossible to write a simple mass action expression for the ion activity of the solution or calculate a disassociation constant for the mixture. It is therefore not possible to use these types of calculations to predict the pH of these materials in the TCLP extraction procedure.

Figure 4:
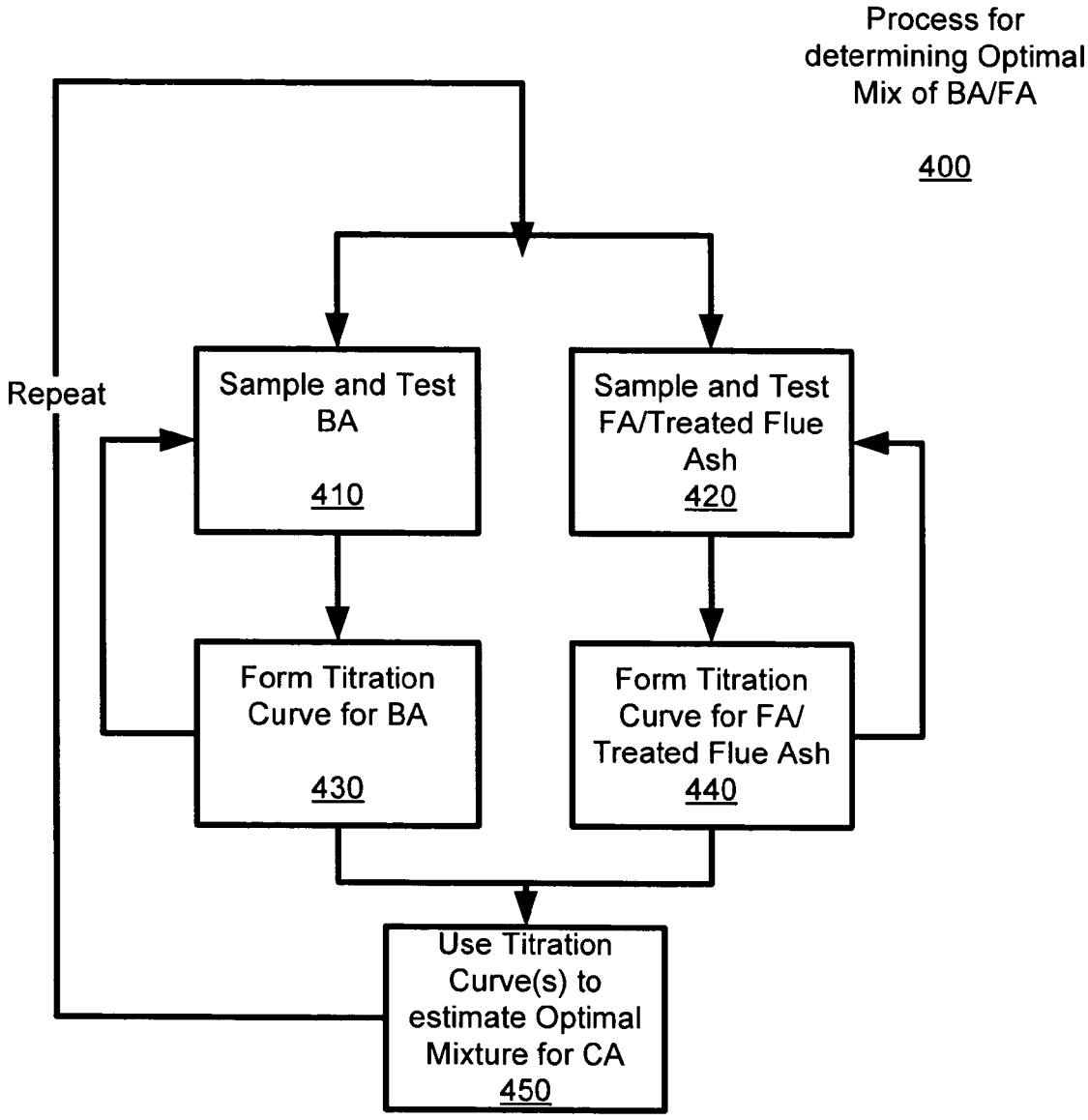

Turning now to FIG. 4, a process 400 for determining an optimal mix of BA/FA is disclosed. In process 400, titration is performed on the BA and FA in water and acetic acid, respectively, in steps 410 and 420. An acid-base titration is a method in chemistry that allows quantitative analysis of the concentration of an unknown acid or base solution. It makes use of the neutralization reaction that occurs between acids and bases.

The results from the titration are then used to form titration curves for the BA and FA in steps 430 and 440. The titration curves for these materials (BA, FA) in water and acetic acid, may be used to provide information to interpolate the needed alkalinity to stabilize the CA mixture as indicated by the material reaching the desired pH range in the TCLP extraction procedure in step 450.

Titrations are often recorded on titration curves, where the independent variable is the volume of the titrant, and the dependent variable is the pH of the solution (which changes depending on the composition of the two solutions). The equivalence point is a significant point on the graph (the point at which all of the starting solution, usually an acid, has been neutralized by the titrant, usually a base).

The titration curves for BA from step 430 typically exhibit a simple weak base variation in pH with the addition of acid, for the reasons described above. Likewise, the titration curves for FA from step 440 present multiple inflection points similar to the multiple inflection points for polyprotic acid titration but the material is strongly basic due to the addition of additives along with the intrinsic characteristics of the FA. These titration curves in conjunction with CA titration curves allow the interpolation of the alkalinity contribution from each stream BA versus FA needed in the CA mixture to assure a stabilized CA mixture that will not allow acid to break up the chelated calcium-carbonate-metal complexes formed in the system.

Continuing with step 450, the titration curves provide pH versus reactive equivalents (EQ) information for each ash stream. The titration curves were done slowly with small increments of acid added and the solution allowed to reach equilibrium before the next addition of a known amount of acid. These curves provided reliable data about the EQ per gram of ash for each ash stream and the corresponding pH of the solution. The EQ/gram of CA shown by the titrations at the desired pH are used to solve an algebraic expression for the amount of BA and FA that should be present in the CA to reach a desired pH level.

Continuing with step 450, the desired pH levels depend on the desired CA ash characteristics. The solubility behavior of the various metal compounds with respect to pH is well documented. It is therefore desirable to keep the CA within the desired pH range for the final TCLP extraction solution. One of the primary concerns in determining an optimal CA mixture is that leaching of Cd and Pb, the two heavy metals of most concern from a health and regulatory perceptive, is minimized in ash that has a final TCLP extraction solution pH in the range of 8-11. Thus, it is generally preferable in step 350 to produce a CA having a pH in this range. It should be appreciated that other pH ranges and values may likewise be desired and achieved using the techniques of the present invention as needed for ash disposal needs.

In tests of the present invention, it is found that approximately one-third of the facility's produced BA should be mixed with the facility's entire FA to achieve a CA material having a desired alkalinity. Therefore, approximately two-thirds of the overall BA will be available for clean recycling of the ash. The typical ratio of BA and FA produced by a facility is approximately four-to-one, i.e., 80% of the total ash is BA and 20% is FA. Since approximately only a third of the BA (80%/3, or about 27%, of the total ash production) is used in the CA of the present invention, a sizable portion of the total ash, a little more than half (80%-the 27% used for the CA) is available for recycling, thereby further reducing the amount of materials safely deposited in landfills. It should be appreciated however, the exact ratio of FA and BA should be determined empirically according the techniques described above to achieve the desired CA characteristics.

Accordingly, it can be seen that the ash processing method 300 effectively reduces or eliminates the need for adding an amendment reagent (i.e. dolomitic lime, additional calcium oxide/hydroxide or other types of reagents) to the FA/BA streams to keep the TCLP extraction pH of the CA in the desired range. Moreover, the amount of the ash to be brought to and disposed of at the landfill is reduced by the weight of the amendment reagent and its associated moisture content, thereby reducing the associated transportation and tipping fees.

Returning now to FIG. 3, the FA and BA are combined in step 360 according to the known techniques in the ratio determined during step 350. The CA from step 360 can then be tested using the TCLP techniques and disposed of in landfills in step 370. Since the CA is engineered to intrinsically conform with environmental requirements, the CA generally requires little or no additional treatment in step 370.

The remaining BA, which may be substantial as described above, is tested according to TCLP techniques and may be disposed of in a landfill or recycled in step 380. The remaining BA will be subject to periodic TCLP testing. Based upon existing data, BA is normally expected to pass TCLP, but if not, amendment of the stream can be accomplished more easily and less expensively than with CA stream. Thus, a large percentage (approximately two thirds) of the BA is diverted from the CA stream. As well known in the field of waste incineration, uncombined BA is much cleaner and therefore more useful for potential recycling. Also, the amount of total ash to be landfilled is significantly smaller if the BA is recycled.

The BA can be split into the two streams of 1) CA and 2) separate ash for recycling or landfilling by mechanical splitters on an ongoing and continuous basis. Alternatively, the desirable amount of BA can be mixed with the FA stream into a CA on a non-continuous, or batch, basis. Valuable commercial uses also exist to recycle the bottom ash.

Continuing with FIG. 3, embodiments of improved ash processing method 300 of the present invention may optionally include removing the grate siftings (riddlings) and/or the boiler ash from the BA in step 340. This would remove a portion of the unburnt carbon from the BA and increase the inertness of the BA. Systems exist to accomplish the removal of the siftings from the BA and to recycle them back into the raw waste feed of the combustor or to combine them directly with the FA.

Furthermore, the recovered ferrous and non-ferrous metals from the bottom ash will have a substantially higher market value if they are free of adhered FA due to treatment of the flue ash for air purification. Secondary cleaning of the recycled products collected in step 320 is less necessary since sticky deposits are minimized washing or other methods of cleaning of recycled materials to remove adhering FA on the siftings is problematic and creates undesirable secondary waste streams which can be avoided if the ash streams are not combined prior to metals separation in step 320.

Figure 5:
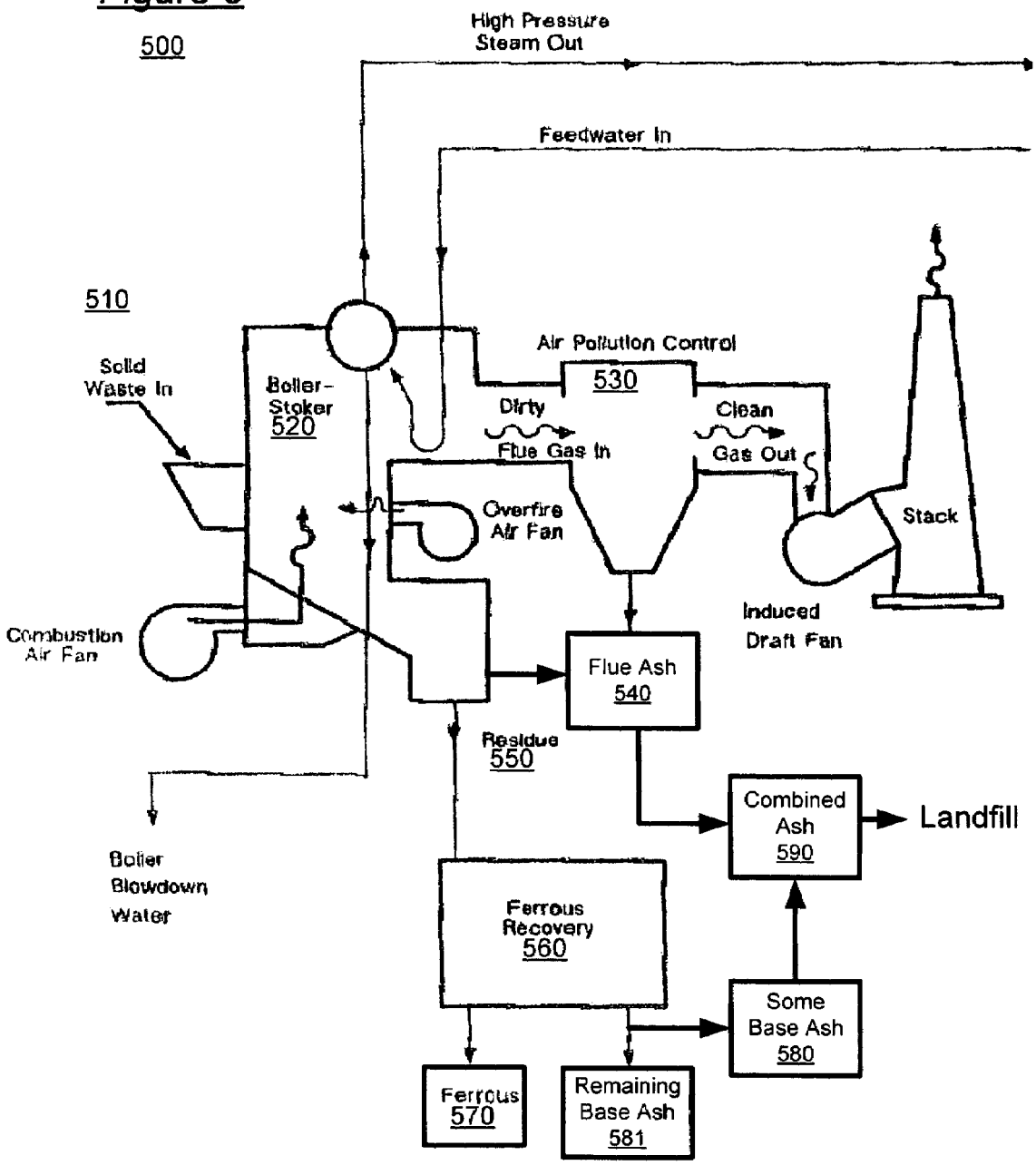
FIG. 5 is schematic diagram of a MWC facility operating in accordance with the improved ash processing method of FIGS. 3-4.

A MWC system 500 for implementing the ash management system 500 is depicted in FIG. 5. The MWC system 500 receives and incinerates the solid waste 510 in a boiler 520. For example, the boiler, or combustor, 520 may be a mass-burn combustor with a reciprocating grate combustion system, a mass-burn combustor with a rotary combustion system, a mass burn combustor with a roller grate system, a mass-burn combustor with a fluidized bed system, a refuse derived fuel combustor with a grate system, a refuse derived fuel combustor with a rotary combustion system, or a refuse derived fuel combustor with a fluidized bed system.

Harmful flue ash from the boiler 520 is removed through an air purification system 530 using standard techniques. For example, as described above, the air purification system 530 may spray a lime reagent into the flue gases to neutralize sulfur dioxide and hydrochloric and other acids, thereby forming a flue ash 540. In one embodiment, the flue ash 540 may be combined with a portion of the boiler fly ash to form a fly ash which is combined with a portion of the bottom ash from the boiler to form a combined ash to be disposed in a landfill.

Alternatively, the residue 550 from the boiler that includes both the bottom ash and the boiler fly ash may be collected. The bottom ash is the ash residue from the incineration which accumulates on the grate, and the bottom ash usually falls directly into a water quench pit or tank from which it is removed to a storage area. The residue 550 may be processed for ferrous recovery 560 to produce ferrous materials 570 for recycling and bottom ash 580. The flue ash 540 is then combined with a portion of the bottom ash 580 to form a combined ash 590 destined for landfills. The remaining bottom ash 581 (separated mechanically or in batch mode) that is not used to form the combined ash 590 may similarly be processed for recycling or disposal.

Conclusion

While the invention has been described with reference to an exemplary embodiments various additions, deletions, substitutions, or other modifications may be made without departing from the spirit or scope of the invention. Accordingly, the invention is not to be considered as limited by the foregoing description, but is only limited by the scope of the appended claims.

The invention claimed is:

1. A method for processing waste from municipal solid combustion for disposal, the waste comprising bottom ash and fly ash, the method comprising the steps of:

separately collecting the BA and the FA;

evaluating the bottom ash and the FA to determine a portion of the bottom ash to be added to the fly ash to produce a combined ash having a set characteristic;

combining the FA and the desired portion of the BA to form the CA.

2. The method of claim 1 further comprising a step of testing the combined ash, wherein the testing is performed using a toxicity characteristic leachate procedure (TCLP).

3. The method of claim 2, further comprising a step of treating the combined ash depending on results from the step of testing the combined ash.

4. The method of claim 1 wherein the set characteristic is a TCLP extraction pH substantially in a range of 8 to 11.

5. The method of claim 4 wherein the step of evaluating the bottom ash and fly ash comprises the steps of forming a bottom ash titration curve, forming a fly ash titration curve, and analyzing the bottom ash and fly ash titration curves to identify the portion of the bottom ash to produce the CA the set characteristic.

6. The method of claim 1 further comprising a step of disposing a remaining portion of the bottom ash representing an amount of the bottom ash remaining after combining of the desired portion of the bottom ash in the combined ash.

7. The method of claim 1 further comprising a step of recycling a remaining portion of the bottom ash representing an amount of the bottom ash remaining after combining of the desired portion of the bottom ash in the combined ash.

8. The method of claim 1 further comprising the step of separating sifting from the bottom ash prior to the step of combining the bottom ash with the desired portion of the bottom ash.

9. The method of claim 1, wherein the portion is substantially a third of the bottom ash.

10. The method of claim 1, wherein the fly ash comprises flue ash and boiler fly ash.

11. The method of claim 1, wherein the fly ash comprises flue ash and the bottom ash comprises boiler fly ash.

12. The method of claim 1, further comprising the steps of repeating the step of evaluating the bottom ash and fly ash, and updating the portion of the bottom ash.

13. A method according to claim 1, wherein the step of combining the fly ash and the portion of the bottom ash to form the combined ash is done on a batch basis.

14. The method of claim 1, wherein the bottom ash is split into a portion and the remaining portion by a mechanical splitter and conveyor which can be operated continuously.

15. A solid waste disposal method comprising the steps of:

combusting the solid waste;

collecting fly ash and bottom ash produced during the step of combusting the solid waste;

evaluating the bottom ash and the fly ash to determine a desired portion of the bottom ash to be added to the fly ash to produce a combined ash having a set characteristic;

combining the fly ash and the desired portion of the bottom ash to form the combined ash; and disposing of the combined ash.

16. The method of claim 15 further comprising a step of disposing a remaining portion of the bottom ash representing an amount of the bottom ash remaining after combining of the portion of the bottom ash in the combined ash.

17. The method of claim 15 further comprising the step of separating sifting from the bottom ash prior to the step of combining the fly ash with the portion of the bottom ash.

18. The method of claim 15 wherein the set characteristic is a pH substantially in a range of 8 to 11.

* * * * *

UNITED STATES PATENT AND TRADEMARK OFFICE

CERTIFICATE OF CORRECTION

PATENT NO. : 7,682,446 B2
APPLICATION NO. : 11/529292
DATED : March 23, 2010
INVENTOR(S) : William C. Goldate et al.

It is certified that error appears in the above-identified patent and that said Letters Patent is hereby corrected as shown below:

On the title page, item [73] should read:

-- (73) Assignee: Covanta Holding Corp., Fairfield, NJ (US) --.

Signed and Sealed this

Eighth Day of June, 2010

David J. Kappos

David J. Kappos
*Director of the United States Patent and Trademark Office*